US008509942B2

(12) United States Patent
Tomimatsu et al.

(10) Patent No.: US 8,509,942 B2
(45) Date of Patent: Aug. 13, 2013

(54) METHOD FOR PRODUCING METAL INGOT, METHOD FOR CONTROLLING LIQUID SURFACE, AND ULTRAFINE COPPER ALLOY WIRE

(75) Inventors: Shuji Tomimatsu, Ichihara (JP); Daisuke Nishide, Chiba (JP)

(73) Assignee: Furukawa Electronic Co., Ltd., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/499,908

(22) PCT Filed: Sep. 12, 2011

(86) PCT No.: PCT/JP2011/070698

§ 371 (c)(1), (2), (4) Date: Apr. 2, 2012

(87) PCT Pub. No.: WO2012/132052

PCT Pub. Date: Oct. 4, 2012

(65) Prior Publication Data

US 2012/0253498 A1 Oct. 4, 2012

(30) Foreign Application Priority Data

Mar. 31, 2011 (JP) ..... 2011-077344

(51) Int. Cl.

| | |
|---|---|
| ***B29C 39/00*** | (2006.01) |
| *G06F 19/00* | (2011.01) |
| *B22C 19/04* | (2006.01) |
| *B22D 46/00* | (2006.01) |
| *B22D 11/18* | (2006.01) |

(52) U.S. Cl.

USPC ..... 700/197; 700/145; 700/146; 700/198; 700/204; 164/80; 164/154.1; 164/453; 164/463; 148/195

(58) Field of Classification Search

USPC ..... 700/145–147, 197–198, 204; 164/80–81, 164/154.1, 451–453, 461–463; 18/195; 148/195

See application file for complete search history.

(56) References Cited

U.S. PATENT DOCUMENTS

| | | | | | |
|---|---|---|---|---|---|
| 5,182,056 | A | * | 1/1993 | Spence et al. | 264/401 |
| 5,786,999 | A | * | 7/1998 | Spahr et al. | 700/200 |
| 5,835,379 | A | * | 11/1998 | Nakano | 700/197 |

(Continued)

FOREIGN PATENT DOCUMENTS

| | | |
|---|---|---|
| JP | 03-210946 | 9/1991 |
| JP | 06-188044 | 8/1994 |

(Continued)

*Primary Examiner* — Ramesh Patel

(74) *Attorney, Agent, or Firm* — Bui Garcia-Zamor; Jessica H. Bui, Esq.

(57) ABSTRACT

Surface 27 of molten metal within a mold is constantly monitored by camera 25. Camera 25 records the surface from an obliquely upward position of the mold in an area that does not affect the casting process. Various analyzing frames such as analysis band 35, molten metal pattern 37, and injection monitoring part 43, are set with respect to the information recorded by the camera 25. The analysis band 35 includes the surface (molten metal part 31*c*), and is set to a predetermined width so that the direction of surface change is in the longitudinal direction. The width of the analysis band 35 is set as wide as possible in a range that does not block the discharge part (molten metal part 31*a*). Inside the analysis band 35, the rate of change of the binary data is calculated by the analyzing part.

10 Claims, 8 Drawing Sheets

(56) References Cited

U.S. PATENT DOCUMENTS

| | | | | |
|---|---|---|---|---|
| 6,490,501 | B1 * | 12/2002 | Saunders | 700/198 |
| 6,532,397 | B1 * | 3/2003 | Yamamoto | 700/197 |
| 7,096,083 | B2 * | 8/2006 | Kaneto et al. | 700/97 |
| 7,167,773 | B2 * | 1/2007 | Schneider et al. | 700/198 |
| 7,513,962 | B2 * | 4/2009 | de Figueredo et al. | 148/549 |
| 8,176,966 | B2 * | 5/2012 | Yoshida et al. | 164/55.1 |
| 8,201,614 | B2 * | 6/2012 | Yoshida et al. | 164/453 |
| 2004/0099351 | A1 * | 5/2004 | de Figueredo et al. | 148/549 |
| 2004/0148051 | A1 * | 7/2004 | Straus | 700/198 |
| 2005/0049739 | A1 * | 3/2005 | Kramer et al. | 700/119 |
| 2010/0307711 | A1 * | 12/2010 | Yoshida et al. | 164/451 |
| 2010/0307712 | A1 * | 12/2010 | Yoshida et al. | 164/453 |
| 2011/0167905 | A1 * | 7/2011 | Arzberger et al. | 73/295 |

FOREIGN PATENT DOCUMENTS

| | | |
|---|---|---|
| JP | 07-266014 | 10/1995 |
| JP | 09-239524 | 9/1997 |
| JP | 2001-099694 | 4/2001 |

* cited by examiner (a)

(b)

METHOD FOR PRODUCING METAL INGOT, METHOD FOR CONTROLLING LIQUID SURFACE, AND ULTRAFINE COPPER ALLOY WIRE

TECHNICAL FIELD

The present invention relates to a method for controlling liquid surface that enables controlling by monitoring the fluctuation in liquid surface, a method for producing metal ingot, and an ultrafine copper alloy wire produced by said methods.

BACKGROUND ART

Conventionally, a method for creating metal ingot by continuous casting of metals such as copper alloy is known. In casting, ingot is obtained by solidifying metal while continuously pouring molten metal into a mold.

One factor that affects the quality of ingot is the mold level (hereinafter referred to as "surface height") of molten metal within the mold. The fluctuation of molten metal surface height causes the thickness of the chill layer on the surface of the ingot and the size of the metal structure to become unstable. Further, it can also cause casting troubles such as overflowing and run-down of the molten metal. Therefore, it is desirable for the molten metal surface height within the mold to be controlled as constant as possible.

As a means to monitor molten metal surface height within a mold, a method of controlling molten metal surface position along six lines, by importing image of the molten metal surface within the mold using a CCD camera, is known (Patent Document 1).

PRIOR ART DOCUMENTS

Patent Documents

Patent Document 1: JP-A-H06-188044

SUMMARY OF THE INVENTION

Technical Problem

However, in conventional methods such as that described in patent document 1, although analysis is performed on six lines, the molten metal surface height in between these lines are not considered, and irregular points may be spread throughout multiple lines. Thus, it is often affected by ruffles etc. on the molten metal surface, and may not ensure accurate understanding of the molten metal surface. Therefore, molten metal surface control is not precise and it is difficult to stabilize the molten metal surface.

Specifically, as a method of continuously casting long ingots, a rotational transfer mold is known. In a rotational transfer mold, unlike the common continuous casting mold for billet and slab, the volume of molten metal within the mold (mold size) against the amount of molten metal injection from the spout is extremely small. Hence, a small fluctuation in the amount of molten metal injection causes a large change in the molten metal surface within the mold. Therefore, a method of controlling molten metal surface that is especially accurate is desired.

Further, when the fluctuation in molten metal surface is large, the quality of the ingot becomes unstable. Thus, especially when obtaining ultrafine copper alloy wires from such ingot, thinning of wire by wire drawing was limited due to microscopic defects attributed from the quality of the ingot.

The present invention was made in view of such problems, and its object is to provide a method for producing metal ingot etc. that, for example, enables precise monitoring of the molten metal surface within the mold and accurate control of molten metal surface.

Means to Solve the Problem

The first invention for attaining the above-mentioned object is a method for producing metal ingot, which comprises the use of a production apparatus comprising a mold, a spout that pours molten metal in a tundish to said mold, a stopper that adjusts opening of said spout, a camera that records image of surface of molten metal within said mold, an analyzing part that analyzes image recorded by said camera, and a controlling part that adjusts the opening of said spout based on information analyzed by said analyzing part; wherein said analyzing part sets an analysis band along a direction of change of said surface on the surface image recorded by said camera, and said analysis band has a predetermined width and includes said surface, binarizes image within said analysis band to a molten metal part and a non molten metal part, obtains rate of change of the binary data for the longitudinal direction of said analysis band, and identifies the lowest position among the positions where the peak of the calculated rate of change is equal to or above a predetermined standard value as the surface height; and wherein said controlling part adjusts the opening of said spout by comparing said surface height with a standard surface height.

Said analyzing part may analyze image data at a regular interval, average multiple image data within a predetermined time, and calculate said peak.

Said analyzing part preferably recognizes partial shape of the binarized molten metal part within the recording field of said camera, compares pattern shape corresponding to said shape of molten metal part with said shape of molten metal part, and constantly corrects position so that said shape of molten metal part and said pattern shape overlap, thereby revising the position of the analyzing part within the recording field of said camera.

Said analyzing part may monitor width of molten metal poured from a molten metal injection part to said mold within the recording field of said camera, corrects opening of said spout according to the width of molten metal at said injection part, and gives off an abnormal signal when the width of molten metal at said injection part becomes 0.

Said analyzing part may control said spout to a closing direction when it is determined that the surface of molten metal has reached the upper limit of said analysis band, and give off an abnormal signal when it is not determined that the surface has declined within a predetermined time.

For said peak, the boundary between the molten metal part and the non molten metal part may be formed along the longitudinal direction of the analysis band, and the rate of change may be said to be 100% when there is no inclination in the rate of change between black and white at said boundary, and the rate of change may be said to be 0% when there is no change in black or white at parts other than said boundary, and said standard value may be set in the range of 50% to 80%.

An upper limit may be set for the opening of said spout. The opening of said spout may be corrected according to the molten metal surface height within said tundish.

According to the first invention, by using image analysis that analyzes molten metal surface height, and setting an analysis band that has a predetermined width, the molten metal surface position is identified by the rate of change in the color of the binary data (black and white) of the molten metal part and the non molten metal part within the analysis band; thus, it is less susceptible to ruffles and splashes on the molten metal surface, and allows accurate understanding of the molten metal surface height.

Here, the rate of change of the binary data refers to the rate of change obtained by analyzing the derivative value of the change in color between the binary data of black and white in the longitudinal directional position (dh) within the entire width of the analysis band, with respect to the length (h) of the longitudinal direction (It is perpendicular to a width direction and is a direction of fluctuation of molten metal) of the analysis band. For example, at the boundary of the molten metal part and the non molten metal part when there are no ruffles and such on the surface, and the surface is constant at a certain height, the rate of change becomes maximum (100%). Further, when there is no change within the molten metal part or the non molten metal part, it becomes minimum (0%).

Furthermore, by analyzing image data at a predetermined interval, averaging multiple image data within a predetermined time, and calculating the peak, effects of instantaneous molten metal droplets are minimized, and the molten metal surface height is determined more accurately.

Moreover, partial shape of the binarized molten metal part within the recording field of the camera is recognized, and pattern shape corresponding to said shape of the molten metal part is compared with said shape of molten metal part, and position is constantly corrected so that said shape of molten metal part and said pattern shape overlap. That is, the position of the analyzing part within the recording field of the camera can be corrected to an appropriate position. Hence, deviation of the analysis position due to vibration from the equipment, abrasion of the mold, and change of the mold, is automatically corrected, allowing detection of molten metal surface at a constant condition.

Further, by monitoring part of the injection part of the molten metal poured in to the mold within the recording field of the camera, abnormalities such as clogging of spout, malfunction of camera, and presence of obstruction between camera and monitoring part can be detected. Furthermore, by correcting the opening of the spout according to the width of the molten metal injection part, a more accurate molten metal surface adjustment is made possible.

Furthermore, by controlling the spout to a closing direction when it is determined that the surface of molten metal has reached the upper limit of the analysis band, and by giving off an abnormal signal when it is not determined that the surface has declined within a predetermined time, overflow of molten metal from the mold is prevented with certainty.

Also, by setting the standard value of the rate of change of the binary data in the range of 50% to 80%, and by identifying the position at which said standard value is exceeded as the molten metal surface (that is, when the peak is in the range of 50% to 100% or in the range of 80% to 100%, said peak position is recognized as the molten metal surface height), it becomes less susceptible to ruffles on the molten metal surface etc., and the molten metal surface position can be detected more accurately.

Further, by setting an upper limit for the opening of the spout, the amount of molten metal poured in to the mold is controlled, thereby preventing hunting of surface fluctuation and overflow of molten metal from the mold. Also, by correcting the opening of the spout according to the amount of molten metal within the tundish, a more accurate adjustment of molten metal surface is made possible.

The second invention is a method for controlling liquid surface, which comprises the use of a liquid transfer apparatus, comprising a liquid holding part in to which liquid is poured, an injection part for pouring liquid in to said liquid holding part, an opening adjustment part for adjusting opening of said injection part, a camera for recording surface of liquid within said liquid holding part, an analyzing part for analyzing image recorded by said camera, a controlling part for adjusting opening of said injection part, based on information analyzed by said analyzing part; wherein said analyzing part sets an analysis band along a direction of change of said surface on the surface image recorded by said camera, and said analysis band has a predetermined width and includes said surface, binarizes image within said analysis band to a liquid part and a non liquid part, obtains rate of change of the binary data for the longitudinal direction of said analysis band, and identifies the lowest position among the position where the peak of the calculated rate of change is equal to or above a predetermined standard value as the surface height; and wherein said controlling part adjusts the opening of said injection part by comparing said surface height with a standard surface height.

According to the second invention, liquid surface height can be controlled with accuracy for any situation where control of liquid surface is necessary, not limited to metal casting.

The third invention is an ultrafine copper alloy wire with a diameter of less than or equal to 0.03 mm diameter, which is obtained by rolling and wire drawing a copper alloy ingot produced by the method for producing metal ingot of the first invention, wherein the amount of wire drawing per one break is more than or equal to 15 kg.

According to the third invention, an ultrafine copper alloy wire of high quality can be obtained.

Effect of the Invention

According to the present invention, for example, a method for producing metal ingot, that enables monitoring of the surface of molten metal within the mold with high accuracy, while accurately controlling surface, is provided.

BEST MODE FOR CARRYING OUT THE INVENTION

Figure 1:
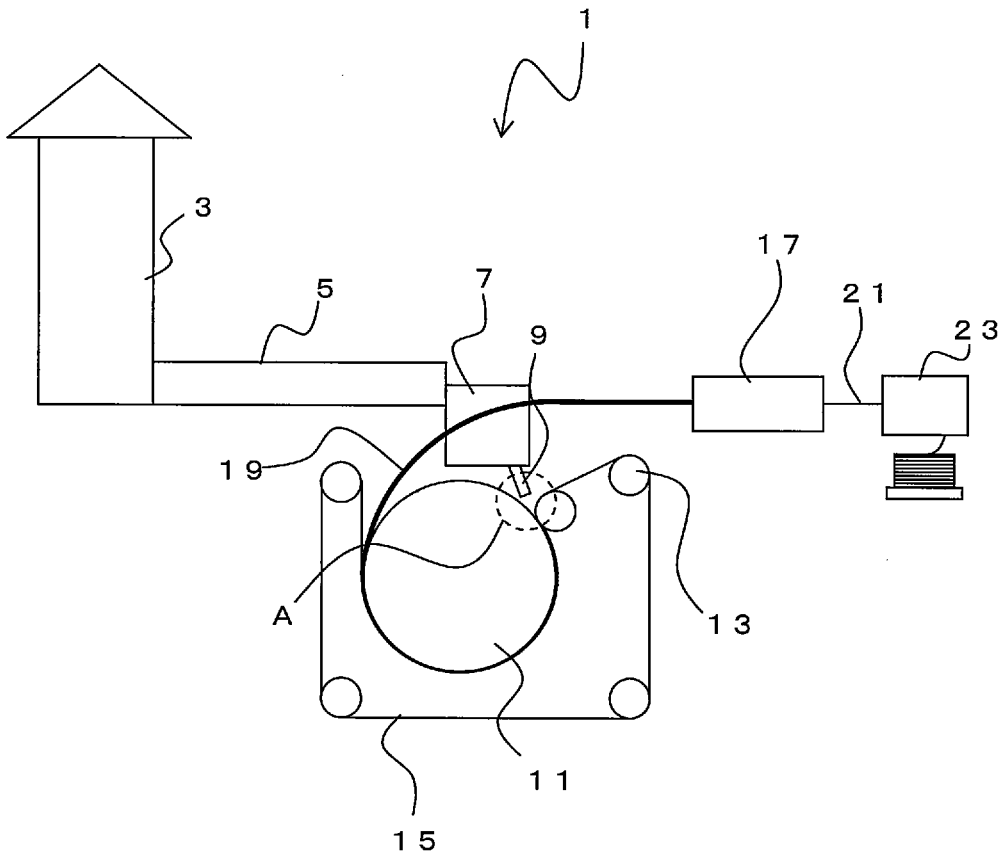
FIG. 1: A figure that shows the continuous casting rolling apparatus.

Hereinafter, embodiments of the present invention will be described with reference to the figures. FIG. 1 is a schematic view of the continuous casting rolling apparatus 1. In the following description, the continuous casting rolling of copper alloy using rotational transfer mold will be indicated as an example of the continuous casting rolling apparatus; however, the present invention is not limited to this. For example, the present invention may, obviously, be applied to other metals, as well. Further, for example, the present invention may be applied to other continuous casting methods, such as a twin belt-type (rotational) transfer mold, constructed of a pair of belts. The continuous casting rolling apparatus 1 consists mainly of a rotational transfer mold, which comprises a shaft furnace 3, a gutter 5, a tundish 7, and a wheel 11 etc., a rolling mill 17, and a winder 23 etc.

The shaft furnace 3 melts, for example, bare metals such as electrolytic copper under a reducing atmosphere. Molten metal melted in the shaft furnace 3 is continuously led to a tundish 7 via a gutter 5. The molten metal in the tundish 7 is poured into a rotational transfer mold, which consists of a belt 15 and a wheel 11, via a spout 9. The belt 15 is transferred by a plurality of turn rolls 13, and covers part of the outer circumference of the wheel 11. The space surrounded by the concaved part (not shown) along the outer circumference of the wheel 11 and the belt becomes the mold.

The molten metal poured into the mold is cooled and solidified in said mold to form an ingot 19. The ingot 19 is continuously pulled out of the mold, subjected to continuous rolling by the rolling mill 17, and becomes a wire rod 21. The wire rod 21 is spooled by the winder 23.

Here, as described in the present embodiment, the ingot of the present invention refers to all cast products obtained by continuously and directly solidifying molten metal. That is, as long as it is a cast product obtained continuously, it will be referred to as an ingot regardless of its form.

Figure 2:
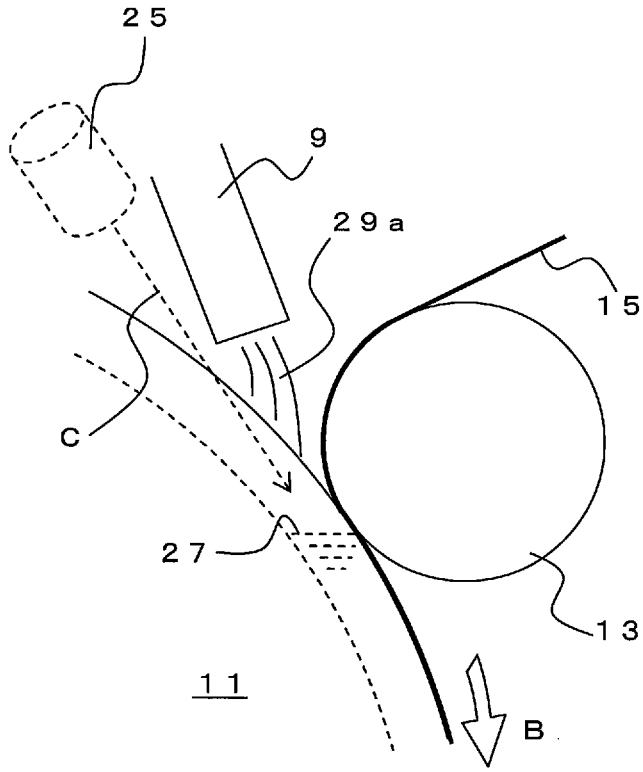
FIG. 2: A magnified view of part A in FIG. 1.

FIG. 2 is a magnified view of part A in FIG. 1, and shows the vicinity of the injection part of the molten metal to the mold. As described previously, the belt 15 is made to be in close contact with the outer circumferential surface of the wheel 11 by the turn roll 13, and the space between the belt 15 and the outer circumferential surface of the wheel 11 becomes the mold. Molten metal 29*a* is injected into the mold from the tundish 7 via the spout 9. The wheel 11 rotates (toward the direction of arrow B in the figure), and continuously cools and solidifies the molten metal inside. Thus, molten metal 29*a* is continuously injected in to the mold.

The molten metal surface 27 inside the mold is constantly monitored (in the direction of arrow C view in the figure) by a camera 25. The camera 25 is, for example, a CCD camera. The molten metal surface 27 changes depending on the balance between the amount that is continuously cast by the wheel 11, which rotates at an almost-constant speed, and the amount of molten metal 29*a* injected. As in the present embodiment, in a rotational transfer mold, the area of molten metal surface with respect to the inner diameter of the spout 9 is especially small (the area of the molten metal surface is about 5 to 30 times the inner diameter of the spout). Therefore, there is a risk that a small change in the discharge amount from the spout 9 will cause a large fluctuation in the molten metal surface.

Figure 3:
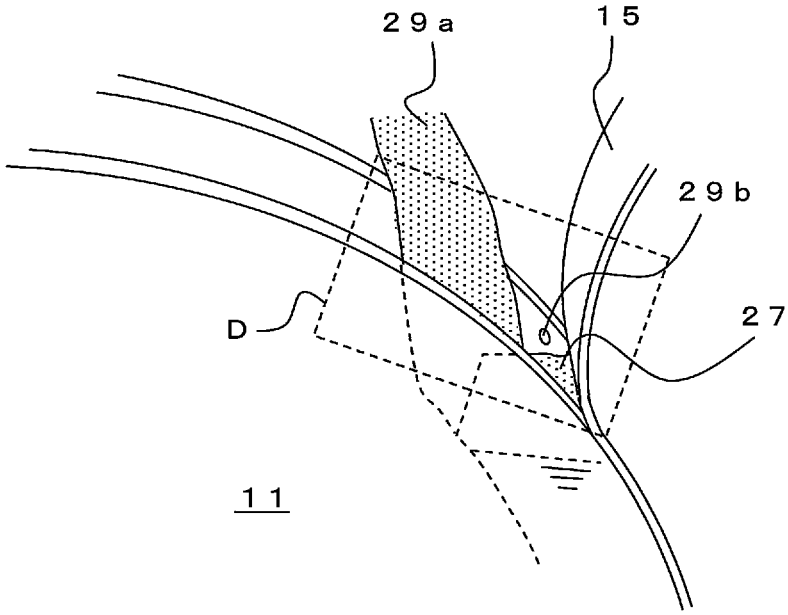
FIG. 3: An arrow C view from camera 25 in FIG. 2.

FIG. 3 is a schematic view of the vicinity of the mold seen from the direction of recording by the camera 25 in FIG. 2. The camera 25 records the surface from an obliquely upward position of the mold in an area that does not affect the casting process. That is, the camera 25 records molten metal including the molten metal surface 27, molten metal 29*a* of the discharge part, and molten 29*b* such as the droplets.

Figure 4:
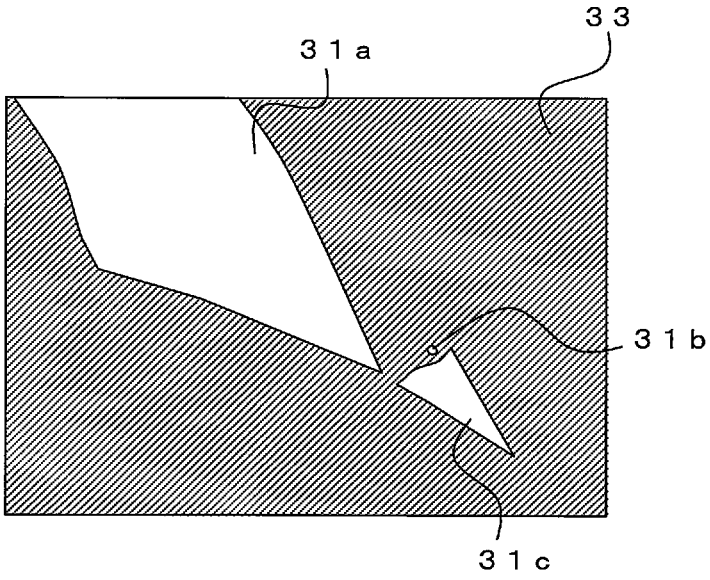
FIGS. 4(*a*)-4(*b*): A conceptual diagram that describes the image recorded by camera 25, wherein FIG. 4(*a*) is the binarized image, and FIG.4(*b*) is the image after setting each analysis frame etc.
Figure 4:
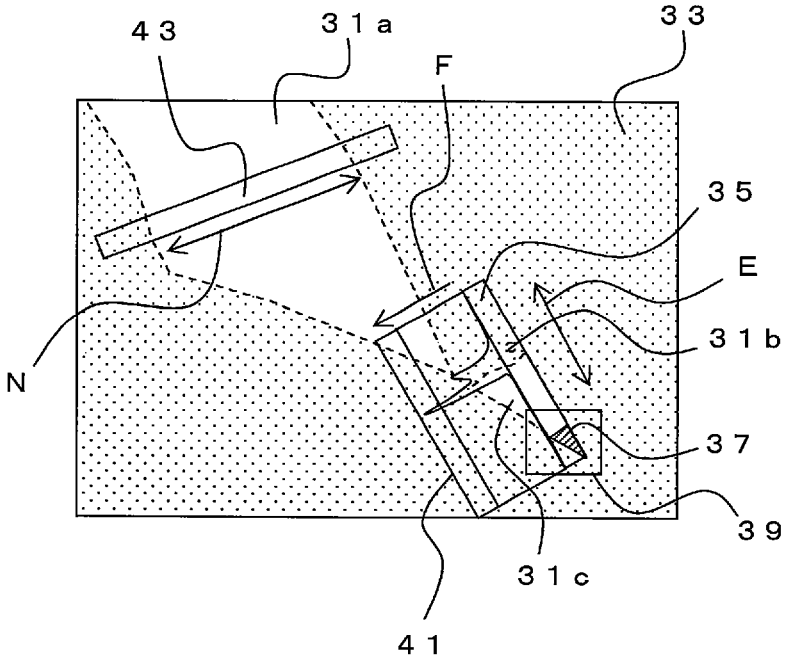

FIG. 4 shows the image of part D in FIG. 3, and is a conceptual diagram of the recording field of the camera 25. FIG. 4(*a*) shows the binarized image of the molten metal part and the non molten metal part, and FIG. 4(*b*) shows the image of the state where each analysis frame etc. are superimposed.

In the image recorded by the camera 25, the brightness is extremely high. Thus, when the image recorded by the camera 25 is binarized by the analyzing part (figure abbreviated), as shown in FIG. 4(*a*), the molten metal part 29*a*, 29*b*, and molten metal surface 27 (FIG. 3) each become white as in molten metal part 31*a*, 31*b*, 31*c*, and the other parts are determined as non molten metal part 33 in black.

Furthermore, as shown in FIG. 4(*b*), the analyzing part sets various analysis frames such as analysis band 35, molten metal pattern 37, and molten metal monitoring part 43. The analysis band 35 includes the molten metal surface (molten metal part 31*c*), and is set at a predetermined width so that the direction of change of the surface is in the longitudinal direction (the direction of the arrow E in the Figure). The width of analysis band 35 is set to be as wide as possible in a range that does not block the discharge part (molten metal part 31*a*).

Inside analysis band 35, the rate of change of the binarized data is calculated by the analyzing part. At the peak displaying part 41, the peak of the calculated rate of change of the binarized data is displayed. That is, the rate of change at each position along the longitudinal direction of the analysis band 35 is displayed in a direction perpendicular to the analysis band 35 (the direction of the arrow F in the figure).

Figure 5:
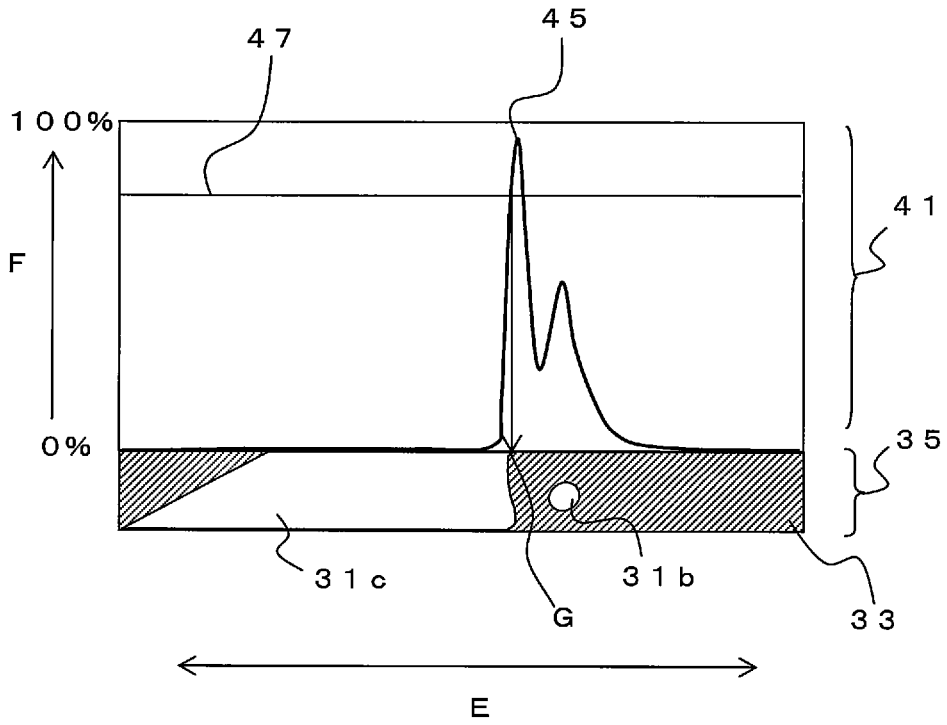
FIG. 5: A conceptual diagram that describes the rate of, change of the binary data.

FIG. 5 is a magnified view of the analysis band 35 and the peak display part 41, and shows the E direction (FIG. 4(*b*)) as the horizontal axis and the F direction (FIG. 4(*b*)) as the vertical axis. Inside the analysis band 35, the binarized data is analyzed. The analyzing part calculates the boundary between the molten metal part 31*c* (white part) and the non molten metal part 33 (black part). For example, inside the analysis band 35, the rate of change in color in a miniscule range (dh) from the left hand side of the figure (where molten metal surface is low) towards the right hand side of the longitudinal direction, is calculated by differentiation. In the example shown in the figure, a large peak 45 is obtained near the molten metal surface. For peak 45, the rate of change is calculated as the change from white to black, for the color change from the side where the molten metal surface is lower. That is, the part for the change from black to white is not calculated as a peak. Hence, only the boundary from the molten metal part (white) to the non molten metal part (black) is recognized as the molten metal surface, and the boundary between non molten metal part (such as the shadow of the mold) and the molten metal part is not recognized as the molten metal surface.

In reality, the molten metal surface has some ripples, so the molten metal surface may not be constant throughout the entire width of the analysis band 35. Further, in the present invention, the image is analyzed every 0.1 seconds, and the peak is calculated as the moving average of, for example, six points (0.6 seconds). Thus, the molten metal surface for the entire width of the analysis band 35 may not always be constant, and the peak 45 may, at times, not be 100%.

In the present invention, the lowest side of the molten metal surface at the position where the peak 45 exceeds the threshold value 47 is identified as the molten metal surface. That is, for the example of FIG. 5, the G position is recognized as the molten metal surface. Here, the threshold value 47 is set at 50 to 80%. Under 50%, there is a risk of falsely recognizing ripples and droplets of molten metal as molten metal surface, and at 80% or over, there is a risk of not being able to recognize the molten metal surface itself, due to ripples on the surface etc.

By taking these steps, the effect of ripples on the molten metal surface can be minimized. Further, for molten metal part 31*b* such as droplets, the peak will not exceed the threshold and false recognition of the surface can be prevented. As described above, the position of molten metal surface within the analysis band 35 can be calculated.

Further, as shown in FIG. 4(*b*), within molten metal part 31*c*, which is the discharge part, an injection monitoring part 43 in, for example, the form of a band is set. The injection monitoring part 43 is always set at the position where the molten metal is, even when the discharge amount is narrowed by adjusting the opening of the spout. That is, normally, the molten metal part (white) is always present within the injection monitoring part 43 while monitoring.

The injection monitoring part 43 monitors the molten metal width (N in the figure) of molten metal part 31*a* at the injection part. The discharge amount of molten metal from the spout is calculated according to the information of the molten metal width of the molten metal part 31*a* at the injection part, which is obtained by the injection monitoring part 43. For example, the discharge amount can be predicted from a relational expression between the molten metal width and the discharge amount, obtained beforehand by tests etc.

If by chance the spout clogs and molten metal stops being injected, or the camera malfunctions, or an obstruction etc. enters the camera's view, causing a situation where accurate monitoring of the surface is not possible, the molten metal width of molten metal part 31*a* becomes 0 at the injection monitoring part 43. In such case, the monitoring part recognizes the situation as abnormal, and transmits an abnormal signal. Specifically, an alarm is transmitted or a light is lighted to notify the worker etc., to safely control the casting apparatus.

Furthermore, the analyzing part memorizes molten metal pattern 37. The molten metal pattern 37 coincides with the shape of the tip of the molten metal part 31*c* inside the mold within the camera's field of view. That is, molten metal pattern 37 is part of the shape of the white part, where the molten metal should always be present. The analyzing part places molten metal pattern 37 to a predetermined position within the pattern controlling range 39.

Figure 6:
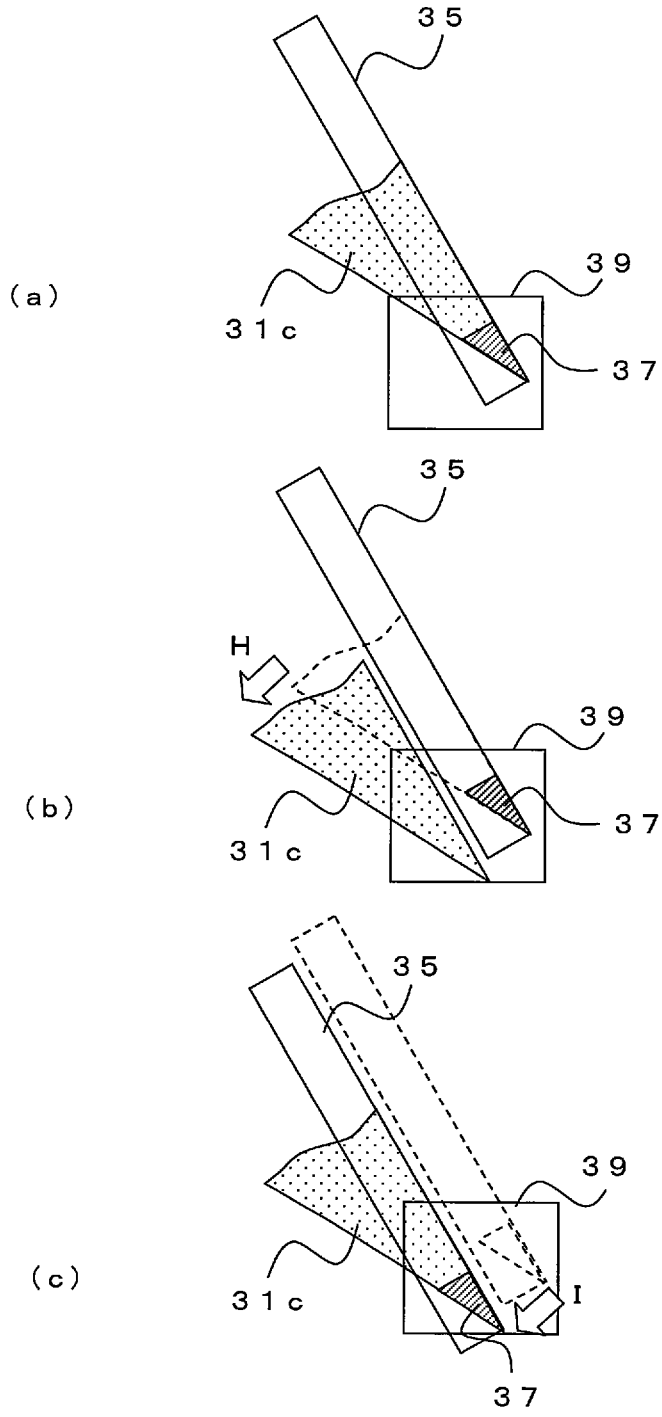
FIGS. 6(*a*)-(*b*): A figure that describes the position correction method of analysis band 35, wherein FIG. 6(*a*) shows the molten metal pattern 37 coincides the shape of the tip on the tip of the molten metal part 31*c*, FIG. 6(*b*) shows the state at which the position of molten metal part 31*c* has deviated from the state of FIG. 6(*a*), and FIG. 6(*c*) shows the position of molten metal part 37 which follows the molten metal parts 31*c*.

FIGS. 6(*a*)-6(*c*) are a conceptual diagram of the control by molten metal pattern. As shown in FIG. 6(*a*), molten metal pattern 37 coincides with the shape of the tip on the tip (low molten metal surface side) of the molten metal part 31*c*. The analyzing part searches for the molten metal part (white part) that coincide with the molten metal pattern 37 within the pattern controlling range 39, and places molten metal pattern 37 to said part. At this point, the other analysis frames such as the analysis band 35 are set according to the position of the molten metal pattern 37.

FIG. 6(*b*) shows the state at which the position of molten metal part 31*c* has deviated from the state of FIG. 6(*a*) (in the direction of the arrow H in the figure). Such situation may be the effect of, for example, vibration of the camera or mold, or fluctuation in molten metal surface (mold) position due to change in mold size or abrasion of mold. As shown in FIG. 6(*b*), calculation of molten metal surface within the analysis band 35 becomes impossible, due to the change in position of the molten metal part 31*c*.

On the other hand, in the present invention, as shown in FIG. 6(*c*), since the position of molten metal pattern 37 constantly follows molten metal part 31*c*, even if the position of molten metal part 31*c* changes, the positions of the analysis frames such as analysis band 35 are constantly corrected to an appropriate position (direction of arrow I in the figure) according to this position of the molten metal part 31*c*. Therefore, the accurate surface position can constantly be understood, regardless of the change in position of the molten metal part 31*c*.

Pattern controlling range 39 is set in a range where there is no false recognition of the position of molten metal pattern 37. For example, as shown in FIG. 4(*a*), the shape of the tip of molten metal part 31*c* is approximately the shape of the tip of molten metal part 31*a*. For this reason, if a pattern controlling range is not set, or if the patter controlling range is too large, there is a chance that the position of the molten metal pattern 37 is falsely recognized as the position of the tip of molten metal part 31*a*. Hence, the pattern controlling range 39 is set beforehand in a range where molten metal pattern 37 may transfer to (in a range where molten metal part 31*a* does not come into view).

As described above, in the present invention, since there is not influence of camera vibration etc., the camera can be positioned in close proximity to the casting apparatus. For this reason, a sufficient amount of light can be secured for the camera's field of view. Thus, the shutter speed can be increased. Hence, the effect of image blurring due to vibration can be minimized. Further, by recording at close proximity to the molten metal part, higher resolution can be obtained.

Figure 7:
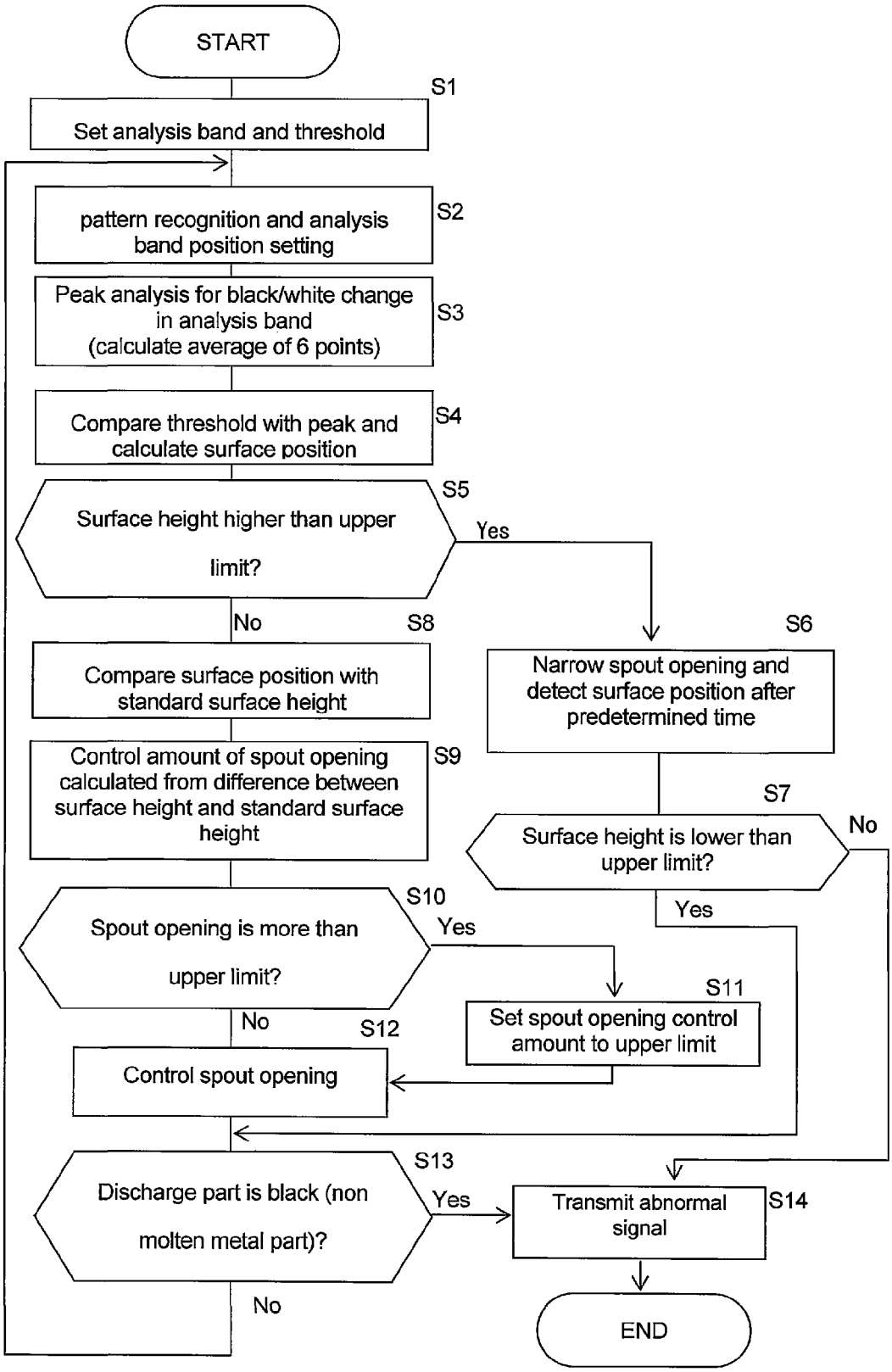
FIG. 7: A flow chart that shows the surface controlling process.

Next, the process for producing metal ingot by the method for controlling liquid surface of the present invention will be described. FIG. 7 is a flow chart that describes the process of molten metal surface control. First, the analyzing part sets an analysis band and a threshold value (step S1). The width and length of the analysis band and the threshold value may, for example, be read out from the information memorized in the memory part.

Subsequently, molten metal is injected into the mold and analysis by the camera begins. First, the pattern of the shape of tip of the molten metal part is recognized, and the positions of the analysis band and the injection monitoring part etc. are set (step S2). Under this state, the peak is analyzed by calculating the rate of change of the black and white within the analysis band (step S3). As for the calculation of peak, for example, an average of six points is obtained. Furthermore, step S2 may be performed for each analysis of the peak.

Next, the analyzing part compares the calculated peak and the threshold value, and identifies the position of the peak that is higher than the threshold of the lowest side of the molten metal surface as the surface height (step S4).

When the surface height is higher than the upper limit of the molten metal surface (step S5), the opening of the spout is narrowed, the molten metal surface position after a predetermined time (for example, 2 seconds later) is detected (step S6), and if the molten metal surface height does not become lower than the upper limit of the molten metal surface, an abnormal signal is transmitted (step S14). If the molten metal surface height does become lower than the upper limit, then the process proceeds to step S13.

When the molten metal surface height is lower than the upper limit of the molten metal surface (step S8), the control amount of the spout opening is calculated from the difference between the molten metal surface height and the standard molten metal surface height (step S9). As for control of the spout opening, the gain of PID control is optimized to prevent hunting etc.

When the spout opening exceeds its upper limit (step S10), the spout opening is set to the upper limit value (step S11) to prevent the spout from opening more than the upper limit.

Subsequently, the controlling part controls the opening of the spout based on the calculated control amount of spout opening (step S12). The controlling part adjusts the opening of spout by, for example, raising or lowering a stopper constructed in the spout, using an electric cylinder that uses a servo motor. As for the electric cylinder, one of high torque such as 200 N, and of high resolution of about 0.02 mm is preferable.

Furthermore, in the injection monitoring part, when the injection part is identified as a non molten metal part (step S13), an abnormal signal is transmitted. By repeating the aforementioned steps, the surface can be made constant at a predetermined position by calculating the surface position and controlling the opening of the spout.

When adjusting the opening of the spout according to the molten metal surface height in the mold (step S12), the opening of the spout may be fine-tuned (correction of opening) with respect to the molten metal width in the molten metal part obtained by the aforementioned injection monitoring part 43.

For example, the standard molten metal width of the injection part in relation to the standard opening of the spout is memorized by the controlling part, and is compared with the molten metal width obtained by the injection monitoring part 43. If the actual molten metal width is narrower than the expected molten metal width, problems such as slag accumulation in the spout and unsmooth flow of molten metal may be possible. On the other hand, if the actual molten metal width is wider than the expected molten metal width, there is a chance that abrasion and chipping of the fire-resistant material at the spout etc. has occurred.

Thus, when the molten metal width differs from the estimated molten metal width (or when the amount of change in the molten metal width resulting from the adjustment of spout opening is different from the estimated amount of change), the controlling part makes a slight adjustment to the opening of the spout. Specifically, when the actual molten metal width is narrower than the estimated molten metal width, the spout opening is corrected to the direction of slightly opening it. Similarly, when the actual molten metal width is wider than the estimated molten metal width, the spout opening is corrected to the direction of slightly closing it. This control may always be performed at the same timing as the aforementioned control by the molten metal surface height within the mold, or may be performed at a predetermined interval.

Further, the amount of molten metal discharged from the tundish also depends on the molten metal surface height within the tundish. That is, if the molten metal surface height within the tundish is high, more molten metal is discharged even with the same amount of spout opening. Therefore, as described above, the amount of discharge (molten metal width) fluctuates with the molten metal surface height (amount of molten metal) in the tundish, as well as the change in the amount of discharge due to the volume of slag, the installed condition of the spout, and abrasion of fire-resistant material in the vicinity of the discharge part.

Thus, the analyzing part may monitor the molten metal surface height within the tundish, and fine-tune the amount of spout opening (correction of opening), in response to the molten metal surface height within the tundish. For example, the spout opening can be slightly adjusted by detecting the actual molten metal surface height in relation to a standard molten metal surface height within the tundish.

Specifically, when the actual molten metal surface height is lower than the standard molten metal surface height, the spout opening is slightly corrected to an opening direction. Similarly, when the actual molten metal surface height is higher than the standard molten metal surface height, the spout opening is slightly corrected to a closing direction. Such control may be performed at the same timing as the aforementioned control by molten metal surface height within the mold (such as before or after step S12), or at a predetermined interval (such as once every few cycles for the flow of FIG. 7).

The molten metal surface height within the tundish can be perceived from the amount of molten metal (weight) in the tundish. For example, the weight of the entire tundish may be monitored by a load cell, and the amount of molten metal within the tundish can be calculated from the weight obtained. Thus, the molten metal surface height in response to the amount of molten metal in the tundish can be perceived.

As for the correction of the spout opening by the molten metal width at the discharge part, and the correction of the spout opening by the molten metal surface height within the tundish, either one may be chosen or both may be performed in combination. Further, they can be controlled by PID control.

Furthermore, an abnormal signal may be transmitted when the molten metal width of the discharge part in relation to the spout opening is judged as not being in a predetermined range. Or, an abnormal signal may be transmitted if the amount of discharge in relation to the amount of molten metal within the tundish at a certain spout opening is not in a predetermined range. That is, an abnormal signal may be transmitted when adjustment of discharge amount by adjustment of spout opening becomes difficult due to abnormalities such as clogging of spout and cracking.

Figure 8A:
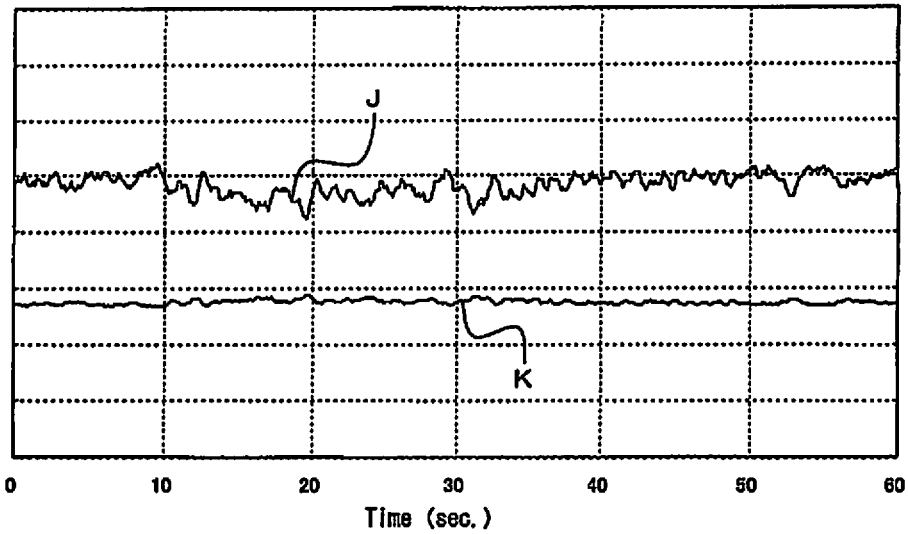
FIGS. 8(*a*)-8(*b*): A figure that shows the change in surface and the change in spout opening, wherein FIG. 8(*a*) shows the result by the present invention, and FIG. 8(*b*) shows the result by a conventional method.
Figure 8B:
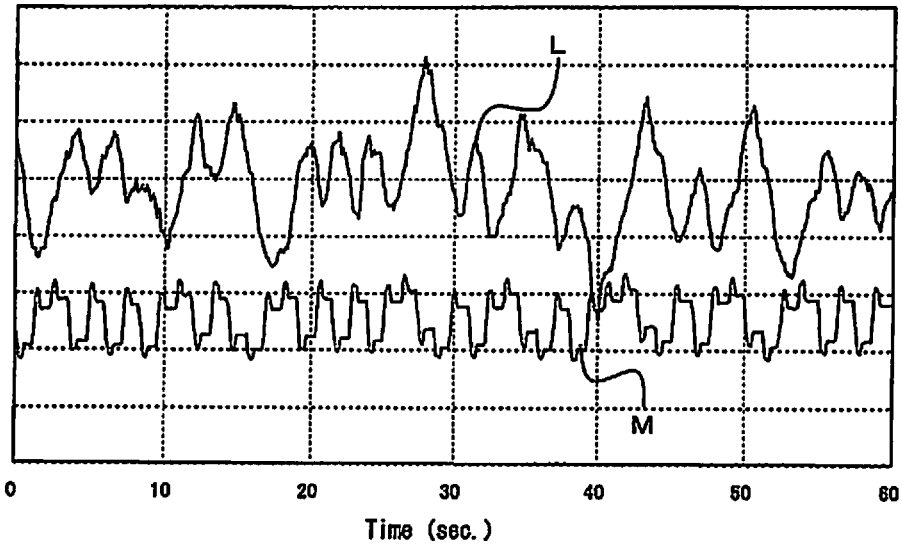
Fig.8(b) PRIOR ART

FIG. 8(*a*) is a diagram that shows the molten metal surface fluctuation controlled by the method of the present invention and the change in spout opening, and the horizontal axis shows time, J in the figure shows molten metal surface fluctuation, and K in the figure shows control of spout opening. As shown in the figure, in the present invention, molten metal surface fluctuation is extremely small and the molten metal surface fluctuation range is kept within ±10 mm.

On the other hand, FIG. 8(*b*) is a diagram that shows the molten metal surface fluctuation controlled by a conventional controlling method and the change in spout opening, and the horizontal axis shows time, L in the figure shows molten metal surface fluctuation, and M in the figure shows control of spout opening. In the conventional method (which does not set a width in the analyzing part that detects molten metal surface as with the analysis band of the present invention, and does not obtain moving average from data of multiple points (time)), molten metal surface fluctuation is large and molten metal surface fluctuation was about ±50 mm.

According to the present invention, an extremely stable molten metal surface can be obtained. Hence, casting troubles can be prevented, and variation of ingot quality due to molten metal surface fluctuation can be suppressed. Specifically, since the analysis band has a predetermined width and the molten metal surface is calculated by the whole analysis band while the molten metal surface is identified by the moving average of a predetermined number, effects of local ripples on the molten metal surface and droplets are minimized, allowing a more accurate detection of molten metal surface position.

Further, by recognizing molten metal surface pattern and always placing the analysis band for molten metal surface analysis to the appropriate position, it is not influenced by vibration and abrasion of mold etc. Moreover, the camera position etc. does not have to be set, even when the mold size is changed.

Furthermore, by constantly monitoring the molten metal at the discharge part, and recognizing abnormality when the discharge part is identified as a non molten metal part, abnormalities such as spout clogging can be detected; further, malfunctions do not occur with abnormalities of camera, or when a worker etc. come into view in front of the camera.

Further, when the molten metal surface exceeds the upper limit of the molten metal surface, the spout opening is narrowed, and when the molten metal surface exceeding the upper limit continues for more than a predetermined time, it is recognized as an abnormality; hence, overflow of molten metal from the mold can be prevented. Furthermore, since an upper limit is set for the spout opening, surface hunting due to excess injection of molten metal can be prevented.

EXAMPLES

A wire rod was produced, using an ingot produced by the method for controlling molten metal of the present invention (surface fluctuation as shown in FIG. 8(*a*)), which was further subjected to wire drawing, and evaluated for its quality. Results are shown in Table 1.

TABLE 1

| | Type | eddy current flaw detection for rough drawing wire | | | 0.03 mm ϕ wire drawing |
|---|---|---|---|---|---|
| | | L defect | M defect | S defect | capability (kg/Br) |
| present invention | tough pitch copper | 0 | 0 | 0 | 15.2 |
| | oxygen-free copper | 0 | 1 | 3 | 20.3 |
| | copper alloy containing 0.7 wt % tin | 0 | 0 | 5 | 22.2 |
| conventional | tough pitch copper | 0 | 0 | 7 | 10.5 |
| | oxygen-free copper | 0 | 4 | 13 | 11.9 |
| | copper alloy containing 0.7 wt % tin | 2 | 8 | 32 | 8.7 |

Tough pitch copper (JIS C1100), oxygen-free copper (JIS C1020), and copper alloy containing 0.7 wt % tin (tinsel cord) were used as copper alloy. The eddy current flaw detection for the rough drawing wire refers to the continuous flaw detection of surface flaw on rough drawing wire by performing eddy current flaw detection to 30 tons of rough drawing wire. L defect, M defect, and S defect refer to the ranks of flaw deepness depending on the flaw detection intensity obtained, and L defect refer to the largest defect among them.

Further, the 0.03 mm diameter wire drawing ability expresses the average amount of wire drawn per one break (kg/Br), when 100 kg of wire drawing process is performed. That is, it expresses the amount of wire drawing that could be performed without breaking. This is an evaluation method for the last process of creating a 0.03 mmϕ wire, using, as the base metal, the rough drawing wire produced by the continuous casting rolling apparatus 1, wire drawing to 2.6 mmϕ by a conventional continuous-wire drawing machine, and subsequently performing multiple wire drawing processes.

The table indicates that the rough drawing wire obtained by the present invention contains few defects, and that no L defect was detected. Further, because there are few defects and the structure is uniform, the amount of wire drawing per one break was more than 15 kg in the following wire drawing process. Especially for oxygen-free copper and copper alloy containing 0.7 wt % tin, more than 20 kg were obtained as the wire drawing amount per one break.

On the other hand, for those produced using ingots obtained by conventional surface controlling methods (FIG. 8(*b*)), many defects occurred in the rough drawing wire, and the wire drawing ability was about 10 kg for all types. This result is thought to be caused by the inclusion of oxides associated with surface fluctuation, uneven thickness of the chill layer on the surface, or by the effect of coarse particles and microscopic defects.

Although favorable embodiments for the present invention have so far been described in detail with reference to the accompanying figures, the technical scope of the present invention is not influenced by these embodiments. It should be understood by those in the field that examples of various changes and modifications are included within the realm of the technical idea of the present invention, and that such examples should obviously be included in the technical scope of the present invention.

For example, although in the present example the control of surface height of the molten metal within the mold during metal casting was described, the present invention is not limited to such example, and may be applied to the detection and control of the surface height of every liquid. For example, in an apparatus etc. that mixes and transports chemicals, when the liquid is poured into the liquid holding part from an injection part, the liquid surface within the liquid holding part can be detected to adjust the opening of the injection part.

In such case, the liquid surface within the liquid holding part is recorded by a camera, and the image recorded by the camera is analyzed by an analyzing part similar to that described above, to identify the liquid surface height, and the opening of the injection part can be controlled by the controlling part so that the surface height meets a standard surface height. Further, an infrared camera that can perceive surface temperature may be used for binarizing data. That is, the liquid part and the non liquid part can be binarized by the liquid temperature. Further, the standard surface height does not necessarily have to be constant, and may be controlled so that the standard surface height changes at a predetermined speed. In such case, the best position for the standard surface is influenced daily by the mold and spout setting errors etc. prior to the start of continuous casting; thus, to determine the position at which the surface stabilizes most, surface fluctuation can be examined for multiple patterns in a predetermined time each immediately after beginning casting, within, for example, five minutes, where the initial rise conditions such as mold temperature stabilizes. This search function should desirably be added to the programmable controller. As for the quantification of surface fluctuation, a method that utilizes standard deviation of surface position data obtained within a predetermined time can be applied.

List of Reference Signs

| | |
|---|---|
| 1 | continuous casting rolling apparatus |
| 3 | shaft furnace |
| 5 | gutter |
| 7 | tundish |
| 9 | spout |
| 11 | wheel |
| 13 | turn roll |
| 15 | belt |
| 17 | rolling mill |
| 19 | ingot |
| 21 | wire rod |
| 23 | winder |
| 25 | camera |
| 27 | molten metal surface |
| 29a, 29b | molten metal |
| 31a, 31b, 31c | molten metal part |
| 33 | non molten metal part |

-continued

| List of Reference Signs | |
|---|---|
| 35 | analysis band |
| 37 | molten metal pattern |
| 39 | pattern controlling range |
| 41 | peak displaying part |
| 43 | injection monitoring part |
| 45 | peak |
| 47 | threshold |

The invention claimed is:

1. A method for producing metal ingot, which comprises the use of a production apparatus comprising:

a mold;

a spout that pours a molten metal in a tundish to said mold;

a stopper that adjusts an opening of said spout;

a camera that records an image of surface of the molten metal within said mold;

an analyzing part that analyzes the surface image recorded by said camera; and a controlling part that adjusts the opening of said spout based on information analyzed by said analyzing part;

wherein said analyzing part sets an analysis band along a direction of change of said surface on the surface image recorded by said camera, and said analysis band has a predetermined width and includes said surface, binarizes an image within said analysis band to a molten metal part and a non molten metal part, obtains a rate of change of binary data for a longitudinal direction of said analysis band, and identifies the lowest position among the positions where the peak of the calculated rate of change is equal to or above a predetermined standard value as a surface height; and wherein said controlling part adjusts the opening of said spout by comparing said surface height with a standard surface height.

2. The method for producing metal ingot of claim 1, wherein said analyzing part analyzes image data at a regular interval, averages multiple image data within a predetermined time, and calculates said peak.

3. The method for producing metal ingot of claim 1, wherein said analyzing part recognizes a partial shape of the binarized molten metal part within a recording field of said camera, compares a pattern shape corresponding to said shape of molten metal part with said shape of molten metal part, and constantly corrects position so that said shape of molten metal part and said pattern shape overlap, thereby revising the position of said analyzing part within the recording field of said camera.

4. The method for producing metal ingot of claim 1, wherein said analyzing part monitors a width of molten metal poured from a molten metal injection part to said mold within a recording field of said camera, corrects the opening of said spout according to the width of molten metal at said injection part, and generates an abnormal signal when the width of molten metal at said injection part becomes 0.

5. The method for producing metal ingot of claim 1, wherein said analyzing part controls said spout to a closing direction when it is determined that the surface of molten metal has reached an upper limit of said analysis band, and generates an abnormal signal when it is not determined that the surface has declined within a predetermined time.

6. The method for producing metal ingot of claim 1, wherein for said peak, the boundary between the molten metal part and the non molten metal part is formed along the longitudinal direction of the analysis band, and the rate of change is to be 100% when there is no inclination in the rate of change between black and white at said boundary, and the rate of change is to be 0% when there is no change in black or white at parts other than said boundary, and said standard value is set in the range of 50% to 80%.

7. The method for producing metal ingot of claim 1, wherein an upper limit is set for the opening of said spout.

8. The method for producing metal ingot of claim 1, wherein the opening of said spout is corrected according to the molten metal surface height within said tundish.

9. An ultrafine copper alloy wire with a diameter of less than or equal to 0.03 mm diameter, which is obtained by rolling and wire drawing a copper alloy ingot produced by the method for producing metal ingot defined in claim 1, wherein the amount of wire drawing per one break is more than or equal to 15 kg.

10. A method for controlling liquid surface, which comprises the use of a liquid transfer apparatus, comprising:

a liquid holding part in to which liquid is poured;

an injection part for pouring liquid in to said liquid holding part;

an opening adjustment part for adjusting an opening of said injection part;

a camera for recording a surface of liquid within said liquid holding part;

an analyzing part for analyzing a surface image recorded by said camera;

a controlling part for adjusting the opening of said injection part, based on information analyzed by said analyzing part;

wherein said analyzing part sets an analysis band along a direction of change of said surface on the surface image recorded by said camera, and said analysis band has a predetermined width and includes said surface, binarizes an image within said analysis band to a liquid part and a non liquid part, obtains a rate of change of binary data for a longitudinal direction of said analysis band, and identifies the lowest position among the positions where the peak of the calculated rate of change is equal to or above a predetermined standard value as a surface height; and wherein said controlling part adjusts the opening of said injection part by comparing said surface height with a standard surface height.

* * * * *